US012162568B2

(12) United States Patent
Huang

(10) Patent No.: US 12,162,568 B2
(45) Date of Patent: Dec. 10, 2024

(54) INFLATABLE STAND-UP PADDLE BOARD

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 244 days.

(21) Appl. No.: 17/849,438

(22) Filed: Jun. 24, 2022

(65) Prior Publication Data

US 2023/0091732 A1 Mar. 23, 2023

(30) Foreign Application Priority Data

Sep. 17, 2021 (CN) ..... 202122260908.4

(51) Int. Cl.
*F04D 29/40* (2006.01)
*B63B 32/51* (2020.01)
*F04D 25/06* (2006.01)

(52) U.S. Cl.
CPC ..... *B63B 32/51* (2020.02); *F04D 25/0673* (2013.01); *F04D 29/403* (2013.01)

(58) Field of Classification Search
CPC .... B63B 32/51; F04D 25/0673; F04D 29/403
See application file for complete search history.

(56) References Cited

U.S. PATENT DOCUMENTS 7,198,076 B2 * 4/2007 Wu ..... F04D 27/00 141/10
2013/0059489 A1 * 3/2013 Vlock ..... B60L 1/003 440/6
2014/0276290 A1 * 9/2014 Mansur, Jr. ..... A61H 9/0078 601/152
2015/0034196 A1 * 2/2015 Petrucci ..... F04D 25/06 137/899.4
2018/0065717 A1 * 3/2018 Sitar ..... B63H 16/04
2019/0168849 A1 * 6/2019 Sebastjan ..... B63B 32/51
2020/0049156 A1 * 2/2020 Lau ..... F04D 25/084

FOREIGN PATENT DOCUMENTS

DE 102015100275 7/2016
WO 2016175709 11/2016
WO 2018020308 2/2018

OTHER PUBLICATIONS

Extended European Search Report dated Feb. 14, 2023 (Feb. 14, 2023) issued on related European patent application 22185312.0 by the European Patent Office.

* cited by examiner

*Primary Examiner* — Courtney D Heinle
*Assistant Examiner* — Andrew J Marien
(74) *Attorney, Agent, or Firm* — DICKINSON WRIGHT PLLC

(57) ABSTRACT

An inflatable stand-up paddle board is provided including: a body including a top sheet, a bottom sheet, and an outer sheet defining an inflatable chamber. The board further includes an inner sheet defining an installation space spaced apart from the inflatable chamber by the inner sheet. An air pump assembly is disposed in the installation space and includes: a casing, and an air pump including an air inlet that communicates with an exterior of the inflatable chamber, and an air outlet that communicates with the inflatable chamber via a first vent hole in the inner sheet.

16 Claims, 9 Drawing Sheets

INFLATABLE STAND-UP PADDLE BOARD

CROSS-REFERENCE TO RELATED APPLICATION

This application claims priority from Chinese Application CN202122260908.4 filed Sep. 17, 2021 in China, the disclosure of which is incorporated herein by reference in its entirety.

BACKGROUND

1. Field

Apparatuses and methods consistent with example embodiments relate to an inflatable stand-up paddle board.

2. Description of the Related Art

A stand-up paddle board (SUP board) is a sports apparatus that is becoming increasingly popular. A user stands on a stand-up paddle board and can generally move forwards by paddling with a single paddle. A stand-up paddle board can also be used for surfing. To facilitate storage, a stand-up paddle board may also be inflatable. Generally, a user connects an external air pump to an inflatable stand-up paddle board to inflate the board; and after air inflation is finished, the user separates and removes the external air pump from the inflatable stand-up paddle board, and is then able to use the inflated stand-up paddle board.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable board comprises: a body comprising: a plurality of outer sheets, and an inner sheet having an upper periphery connected to one of the plurality of outer sheets and a lower periphery connected to another of the plurality of outer sheets, such that the plurality of outer sheets and the inner sheet define an inflatable chamber therein, and the inner sheet defines an installation space separated from the inflatable chamber by the inner sheet; and an air pump disposed in the installation space, the air pump comprising: a casing, and an air pump assembly disposed in the casing, the air pump assembly comprising: an air inlet in communication with an outside of the air pump assembly; and an air outlet in communication with the inflatable chamber via a first vent hole in the inner sheet.

The air pump assembly may further comprise: a switching device configured to switch between a first state, in which air is driven into the inflatable chamber, and a second state in which air is driven out of the inflatable chamber.

The stand-up paddle board body may further comprise a second vent hole in the inner sheet; and the air pump assembly may further comprise a suction port in communication with the inflatable chamber via the second vent hole.

The casing may comprise a box and a top cover detachably sealed to the box.

The casing may further comprise a bottom cover detachably connected to the box.

The air pump may further comprise a battery assembly disposed in the casing, wherein the battery assembly is electrically connected to the air pump assembly.

The battery assembly may comprise a rechargeable battery and a recharging port configured to enable recharging of the battery.

The battery assembly may be detachably connected to the air pump.

According to an aspect of an example embodiment, an inflatable board comprises: a body comprising: a plurality of outer sheets, an inner sheet having an upper periphery connected to one of the plurality of outer sheets and a lower periphery connected to another of the plurality of outer sheets, such that the outer sheets and the inner sheet define an inflatable chamber therein, and the inner sheet defines an installation space separated from the inflatable chamber by the inner sheet, and an air valve disposed in a vent hole in one of the top sheet, the bottom sheet, and the outer sheet; an air pump disposed in the installation space, the air pump comprising: a casing, and an air pump assembly disposed in the casing, the air pump assembly comprising: an air inlet in communication with an outside of the air pump assembly, and an air outlet; and a connecting pipe comprising a first end comprising an air valve, and a second end connected to the air outlet.

The connecting pipe may be moveable between: a first performable state in which the first end of the connecting pipe is connected to the vent hole through the air valve, and the second end of the connecting pipe is connected to the air outlet; and a second performable state in which the connecting pipe is stored in the casing.

According to an aspect of an example embodiment, an inflatable board comprises: a body defining an inflatable chamber therein; a sheet defining an installation space and partitioning the installation space from the inflatable chamber; an air pump assembly disposed in the installation space, the air pump assembly comprising an air pump, an air inlet in communication with an exterior of the inflatable chamber, and an air outlet in communication with the inflatable chamber via a vent hole in the sheet.

The inflatable board may further comprise a cover configured to provide a watertight seal between the installation space and an exterior of the inflatable board.

The air pump assembly may further comprise a battery electrically connected to the air pump.

The battery may be rechargeable and the air pump assembly may further comprise a recharging port configured to enable recharging of the battery.

The air pump assembly may further comprise a power indicator light.

The air pump assembly may further comprise a switch moveable between a first position in which the air pump is configured to drive air into the inflatable chamber and a second portion in which the air pump is configured to draw air out of the inflatable chamber.

The inflatable board may further comprise a connecting pipe configured to connect to the air inlet and sized to fit within the installation space.

The inflatable board may further comprise a top cover and a bottom cover each configured to provide a watertight seal between the installation space and an exterior of the inflatable board.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
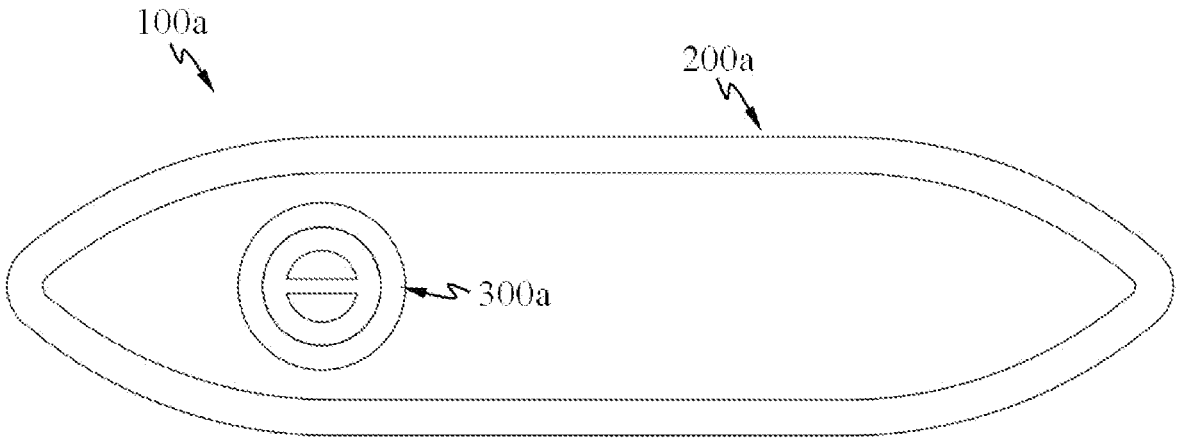
FIG. 1 is a schematic diagram of an inflatable stand-up paddle board according to a first example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

As used herein, unless otherwise specified, the orientation or positional relationship indicated by the terms "front," "rear," "up," "down," "left," "right," and similar terms is based on the orientation or positional relationship shown in the accompanying drawings, which is only for ease of description and simplification of the description, but is not limiting of the example embodiments.

Figure 2:
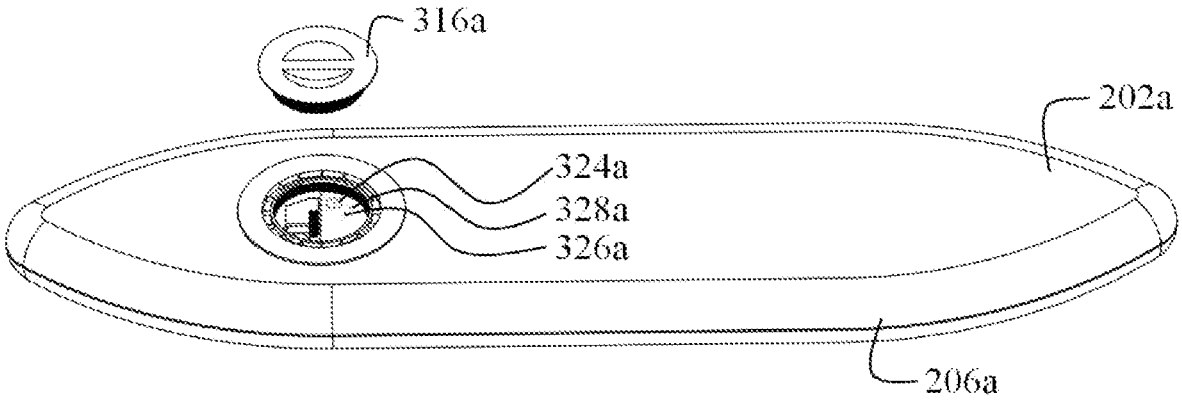
FIG. 2 is an exploded view of the inflatable stand-up paddle board of FIG. 1.
Figure 3:
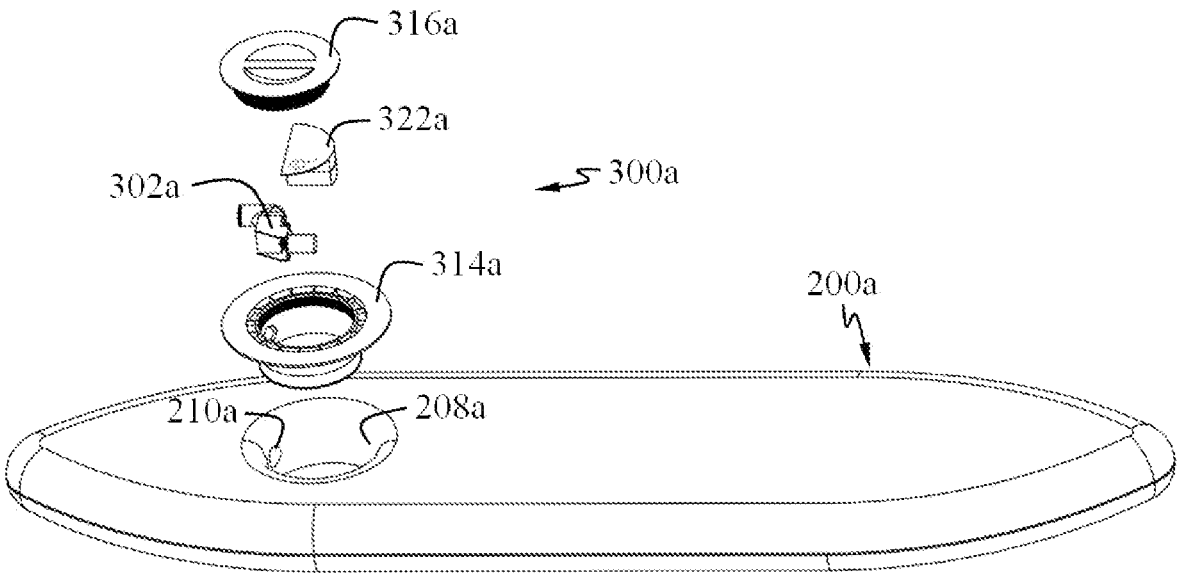
FIG. 3 is a further exploded view of the inflatable stand-up paddle board of FIG. 2.
Figure 4:
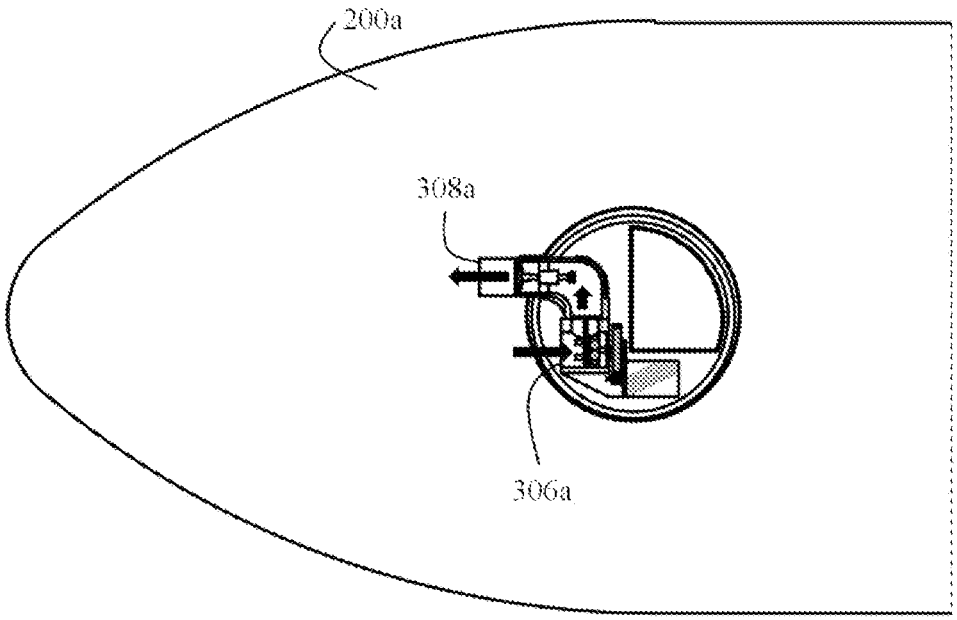
FIG. 4 is a sectional view of the inflatable stand-up paddle board of FIG. 1 in an inflated state.

FIG. 1 is a schematic diagram of an inflatable stand-up paddle board according to a first example embodiment. FIG. 2 is an exploded view of the inflatable stand-up paddle board of FIG. 1. FIG. 3 is a further exploded view of the inflatable stand-up paddle board of FIG. 2. FIG. 4 is a sectional view of the inflatable stand-up paddle board of FIG. 1 in an inflated state. Referring to FIG. 1 to FIG. 4, an inflatable stand-up paddle board 100*a* includes a stand-up paddle board body 200*a* and an air pump 300*a*. The stand-up paddle board body 200*a* includes a top sheet 202*a*, a bottom sheet (not shown), an outer sheet 206*a*, and an inner sheet 208*a*. The outer sheet 206*a* is connected to an outer edge of the top sheet 202*a* and to an outer edge of the bottom sheet; and the inner sheet 208*a* is connected to an inner edge of the top sheet 202*a* and to an inner edge of the bottom sheet. The top sheet 202*a*, the bottom sheet, the outer sheet 206*a*, and the inner sheet 208*a*, together, define an inflatable chamber therein. The inner sheet 208*a* divides the entire stand-up paddle board into two parts: one part being the inflatable chamber and a second part being an installation space. The installation space is substantially located between the top sheet 202*a* and the bottom sheet. The installation space is enclosed by the inner sheet 208*a*, and is spaced apart from the inflatable chamber by the inner sheet 208*a*. In the example embodiment shown in the figures, the inner sheet is enclosed to form the installation space and bulges toward the center of the installation space such that the inner sheet 208*a* may closely fit the shape of a casing of the air pump 300*a*, making installation of the air pump 300*a* reliable and able to provide airtightness.

It should be understood that the installation space may have any of various different shapes according to different example embodiments. For example, in one or more example embodiments, the installation space may be substantially shaped as a square hole, that is, the installation space may be substantially shaped as a cuboid intersecting the stand-up paddle board body 200*a*.

As shown in FIG. 3, the air pump 300*a* includes an air pump assembly 302*a* and a casing. The casing includes a top cover 316*a* and a box 314*a* for accommodating the air pump assembly 302*a* therewithin. Further, the air pump 300*a* includes a battery assembly 322*a* disposed in the casing. The box 314*a* includes a hollow-cylindrical box body and a flange that extends outwards along a radial direction of an upper end of the box body. Of course, the hollow-cylinder shape of the box body is merely an example and the box body may have any of various other shapes in conjunction with any of the example embodiments described herein. When the air pump 300*a* is mounted in the installation space, the flange may partially or fully closely fit the inner sheet 208*a* or the top sheet 202*a* to provide a watertight seal between the flange and the inner sheet 208*a* or the top sheet 202 so as to prevent water from flowing into the air pump or into the inflatable chamber along the inner sheet. As compared with inflatable products such as inflatable mattresses and inflatable toys, in order to provide a solid support to a user, a relatively high internal pressure may be required for an inflatable stand-up paddle board, that is, air pressure in the inflatable chamber may relatively high as compared to air pressure in another type of inflatable product. Accordingly, the flange may provide good airtightness to prevent air leakage from the installation space to an outside of the stand-up paddle board.

A lower end of the top cover 316*a* is provided with external threads, and an upper end of an inner side wall of the box body is provided with internal threads matching the external threads of the top cover 316*a*. The top cover 316*a* and the box 314*a* achieve a detachably sealed connection via the threads. With the sealed connection, water can be prevented from entering the box. A battery in the battery assembly 322*a* may be rechargeable, and a panel of the battery assembly may include a switch 324*a* (see FIG. 2) and a recharging port 326*a* (see FIG. 2). The battery assembly 322*a* may be recharged through the recharging port 326*a*. Further, the panel of the battery assembly 322*a* further includes a power indicator light 328*a*. The battery assembly is electrically connected to the air pump assembly to supply power thereto, and according to one or more example embodiments, the battery assembly is detachably connected to the air pump assembly.

Referring to FIG. 3 and FIG. 4, the air pump assembly 302*a* includes a driving device (not shown), an air inlet 306*a*, and an air outlet 308*a*. The driving device includes a motor that is electrically connected to the battery assembly 322*a*. When the motor is started, the driving device for example drives a piston such that air external to the air pump assembly 302*a*, sucked from the air inlet 306*a*, enters the inflatable chamber via a first vent hole 210*a* through the air outlet 308*a*, thereby achieving air inflation, as shown by the arrows of FIG. 4. After a preset air pressure is reached, the motor of the driving device is stopped. It should be understood that, in the first example embodiment, the air inlet 306*a* is disposed inside the air pump 300*a*, and therefore, during the air inflation, the top cover 316*a* may be kept unsealed with the box 314*a* so as to keep continuous communication between external air and the air inlet 306*a*.

Figure 5:
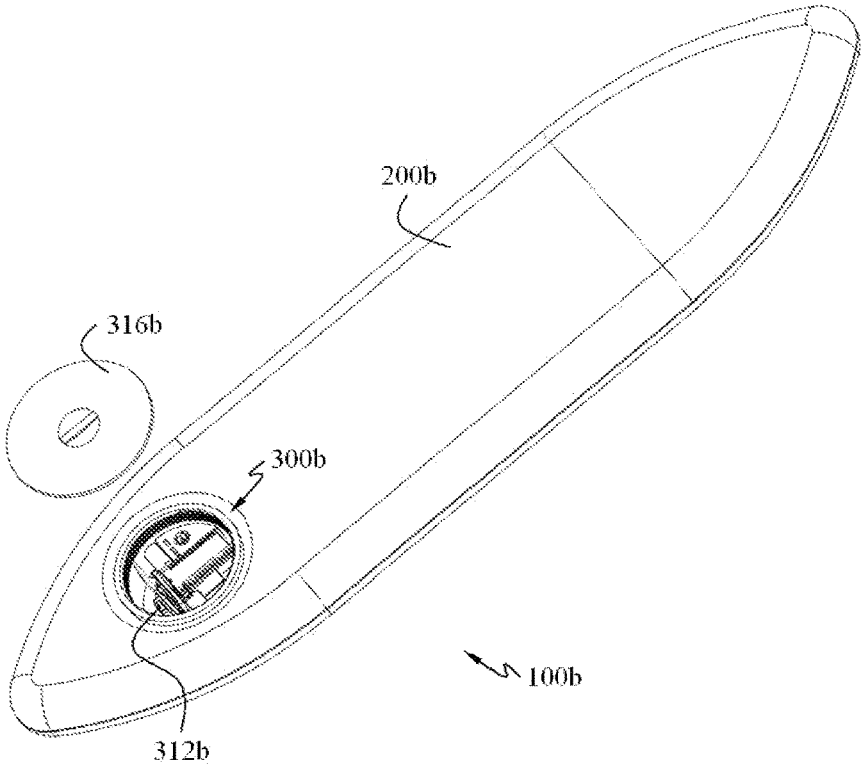
FIG. 5 is an exploded view of an inflatable stand-up paddle board according to a second example embodiment.
Figure 6:
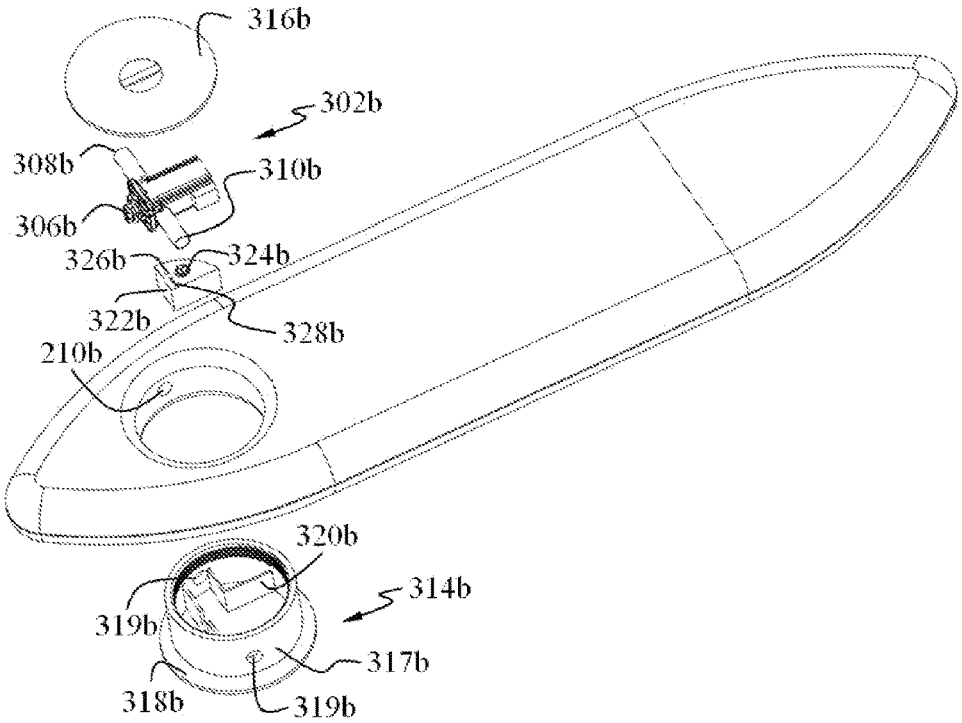
FIG. 6 is a further exploded view of the inflatable stand-up paddle board of FIG. 5.
Figure 7A:
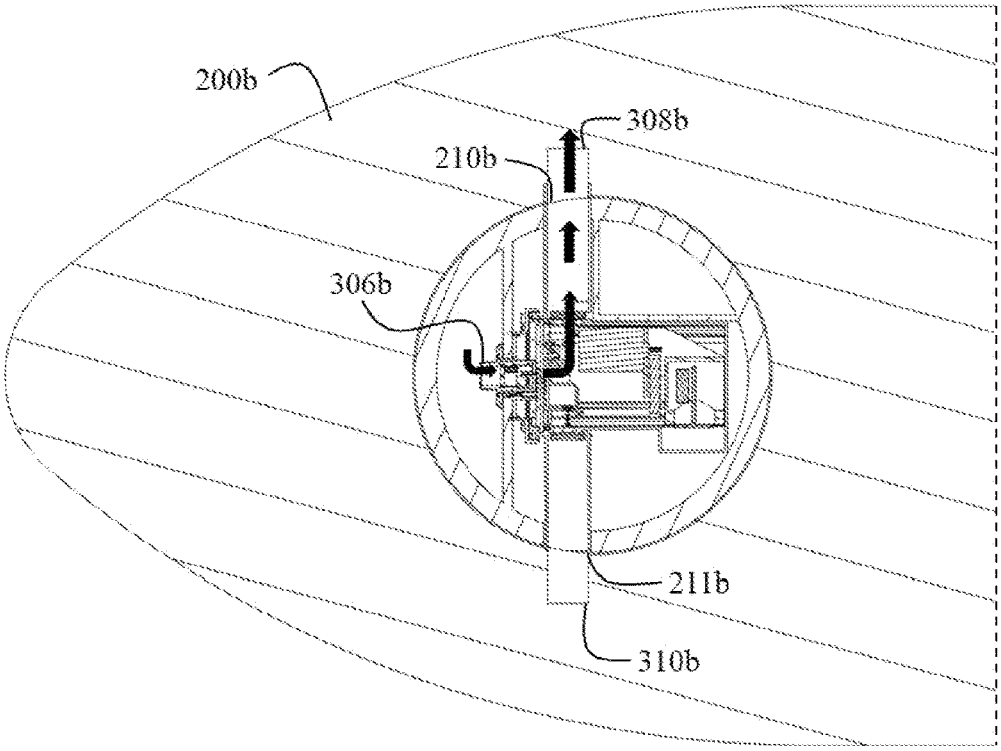
FIG. 7A is a sectional view of the inflatable stand-up paddle board of FIG. 5 in an inflated state.
Figure 7B:
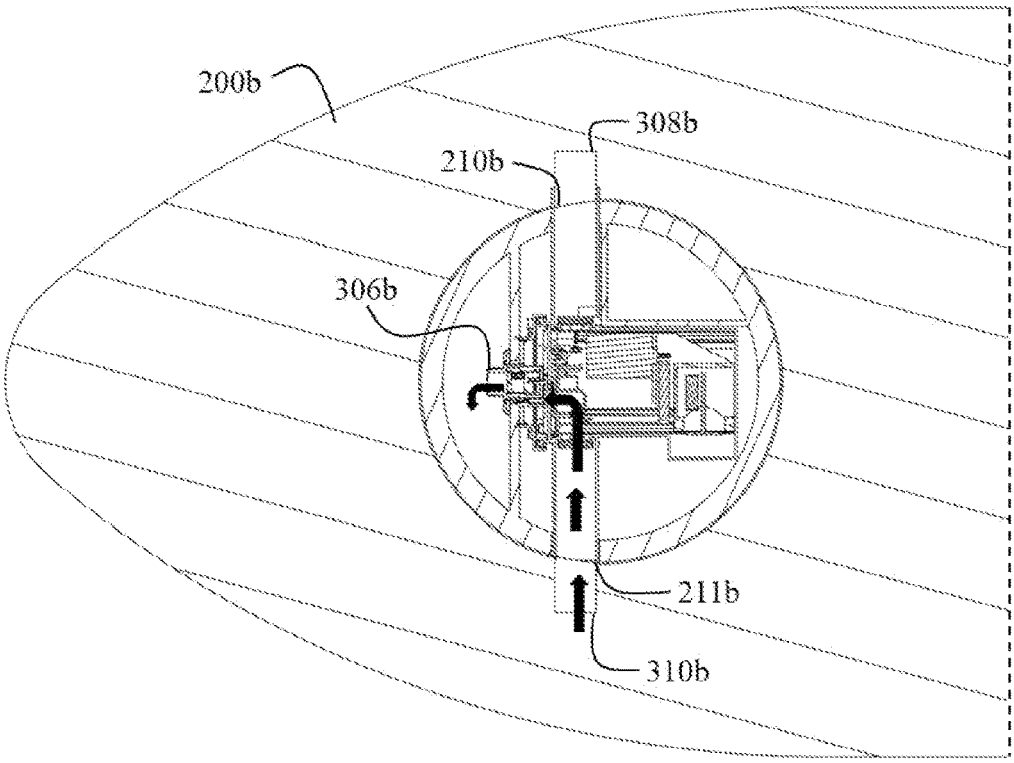
FIG. 7B is a sectional view of the inflatable stand-up paddle board of FIG. 5 in a deflated state.

FIG. 5 is an exploded view of an inflatable stand-up paddle board 100*b* according to a second example embodiment. FIG. 6 is a further exploded view of the inflatable stand-up paddle board of FIG. 5. FIG. 7A is a sectional view of the inflatable stand-up paddle board of FIG. 5 in an inflated state. FIG. 7B is a sectional view of the inflatable stand-up paddle board of FIG. 5 in a deflated state. An inflatable stand-up paddle board 100*b* includes a stand-up paddle board body 200*b* and an air pump 300*b*. The air pump 300*b* includes an air pump assembly 302*b*, a battery assembly 322*b*, and a casing. The air pump assembly 302*b* includes a driving device (not shown), an air inlet 306*b*, an air outlet 308*b*, and a suction port 310*b*. The battery assembly 322*b* includes a switch 324*b*, a recharging port 326*b*, and a power indicator light 328*b*. The air outlet 308*b* communicates with an inflatable chamber via a first vent hole 210*b*; and the suction port 310*b* communicates with the inflatable chamber via a second vent hole 211*b*. A box 314*b* in FIG. 6 includes a hollow body structure in the shape of a hollow cylinder, and a box bottom 318*b*. A diameter of the box bottom 318*b* is greater than a radius of the hollow body structure. The box bottom 318*b* cooperates with a top cover 316*b* such that displacement of the air pump 300*b* may be restrained. When the air pump 300*b* is mounted in the installation space, flanges of the box bottom 318*b* and of the top cover 316*b* may partially or fully closely fit the inner sheet, the top sheet, or the bottom sheet of the stand-up paddle board body 200*b*, such that a seal between the flange and the inner sheet or the top sheet may be watertight so as to prevent water from flowing into the air pump 300*b* or the inflatable chamber along the inner sheet. On the other hand, the flanges described above can also provide good airtightness to prevent air leakage from the installation space to an outside of the board body 200*b*. In other words, with the top cover 316*b* and the box bottom 318*b*, the air pump 300*b* may be fastened to, rather than separated from, the stand-up paddle board body. A side wall 317*b* of the box is provided with two through holes 319*b* that are respectively used for the air outlet 308*b* and the suction port 310*b*, as shown in FIG. 7A and FIG. 7B, to penetrate from the inside of the box 314*b*, and extend into the inflatable chamber. In addition, the inside of the box 314*b* is divided into at least two areas by a partition plate 320*b*. For example, the at least two areas include a larger area and a smaller area, as shown in FIG. 6. A portion of the side wall in the smaller area does not include the two through holes 319*b* such that water leakage into the smaller area due to unexpected water permeating the smaller area via the through holes 319*b* is avoided.

In addition, the air pump assembly 302*b* further includes a switching module, the switching module including a switch knob 312*b* (see FIG. 5), and air channels in the air pump assembly can be switched in response to operation of the switch knob 312*b*. Referring to FIG. 7A, when the switching module is in a first position, external air passes through the air inlet 306*b* to communicate with the inflatable chamber through the air outlet 308*b* to form a first air channel, and the driving device (not shown) drives, for example, a piston to drive air to inflate the inflatable chamber through the first air channel. Referring to FIG. 7B, when the switch knob 312*b* is operated such that the switching module is in a second position, the inflatable chamber communicates with external air through the suction port 310*b* via the air inlet 306*b* to form a second air channel, and the driving device (not shown) drives for example a piston to drive air to deflate the inflatable chamber through the second air channel. After a preset air pressure is reached, the driving device of the air pump 300*b* stops. It should be understood that, in the second example embodiment, the air inlet 306*b* plays a role of an air inflation inlet during air inflation, and also plays a role of an exhaust outlet during air deflation.

In one or more example embodiments, the air pump 300*b* is configured to be removable from the stand-up paddle board body 200*b*. When the air pump 300*b* is being mounted to the stand-up paddle board body 200*b*, the box 314*b* of the air pump assembly 302*b* may be first mounted in the installation space from a bottom of the stand-up paddle board body 200*b*; and then the air outlet 308*b* of the air pump assembly 302*b* communicates with the first vent hole 210*b*, and the suction port 310*b* of the air pump assembly 302*b* is coupled to the second vent hole 211*b*. When the inflatable chamber of the inflatable stand-up paddle board according to the second example embodiment is to be inflated, the switch 324*b* is triggered, the air pump 300*b* starts to work and to inflate the inflatable chamber that was deflated, and after a preset air pressure is reached, the driving device of the air pump 300*b* stops working; and the top cover 316*b* may be screwed into the box 314*b*.

Figure 8:
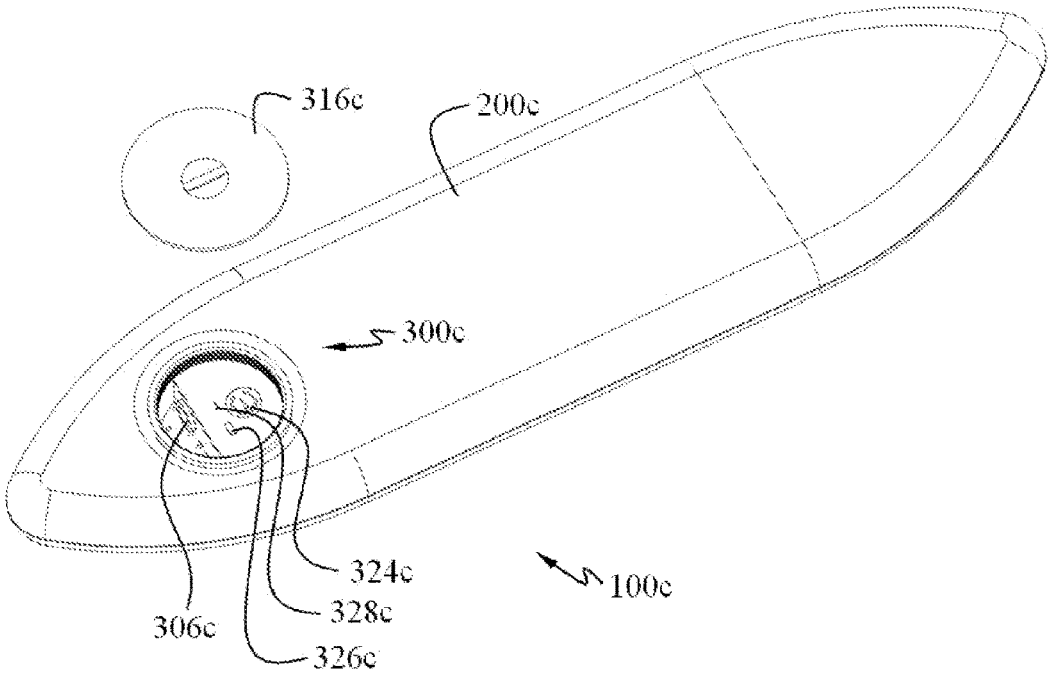
FIG. 8 is an exploded view of an inflatable stand-up paddle board according to a third example embodiment.
Figure 9:
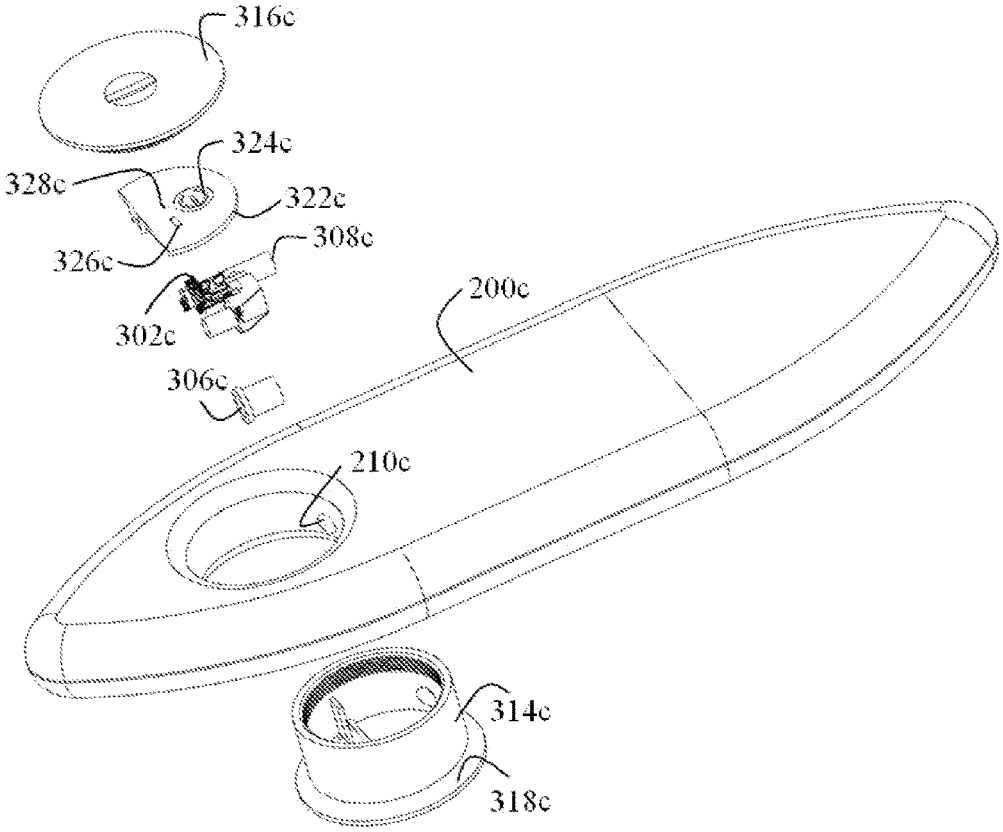
FIG. 9 is a further exploded view of the inflatable stand-up paddle board of FIG. 8.
Figure 10A:
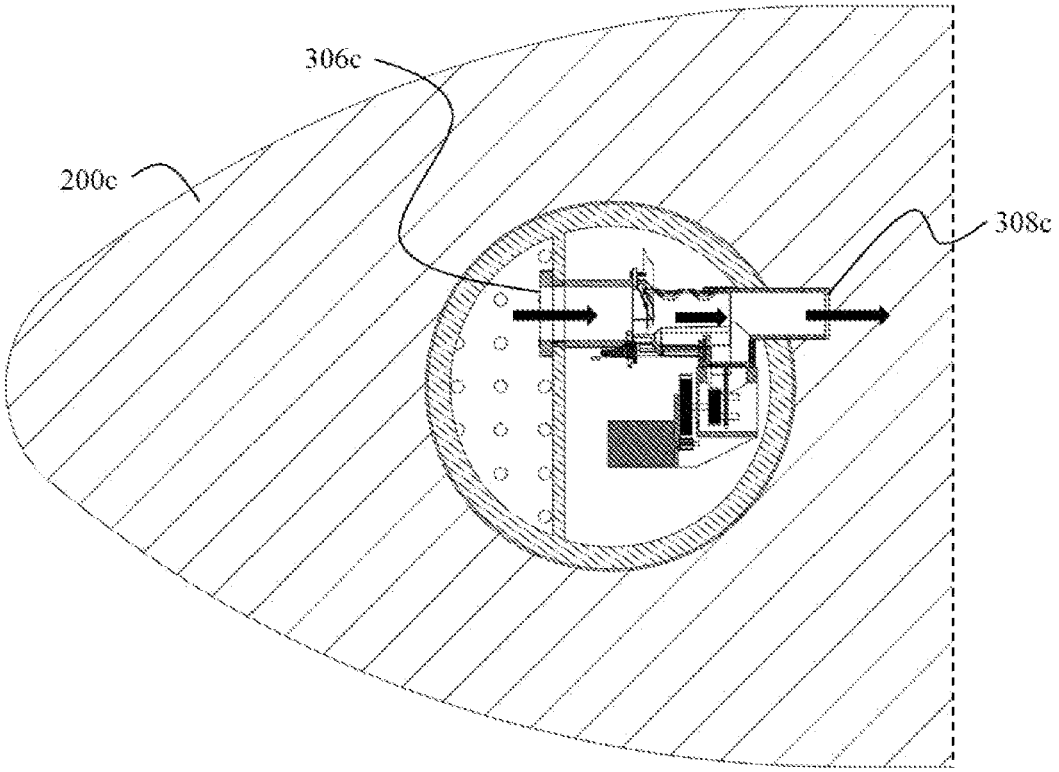
FIG. 10A is a sectional view of the inflatable stand-up paddle board of FIG. 8 in an inflated state.
Figure 10B:
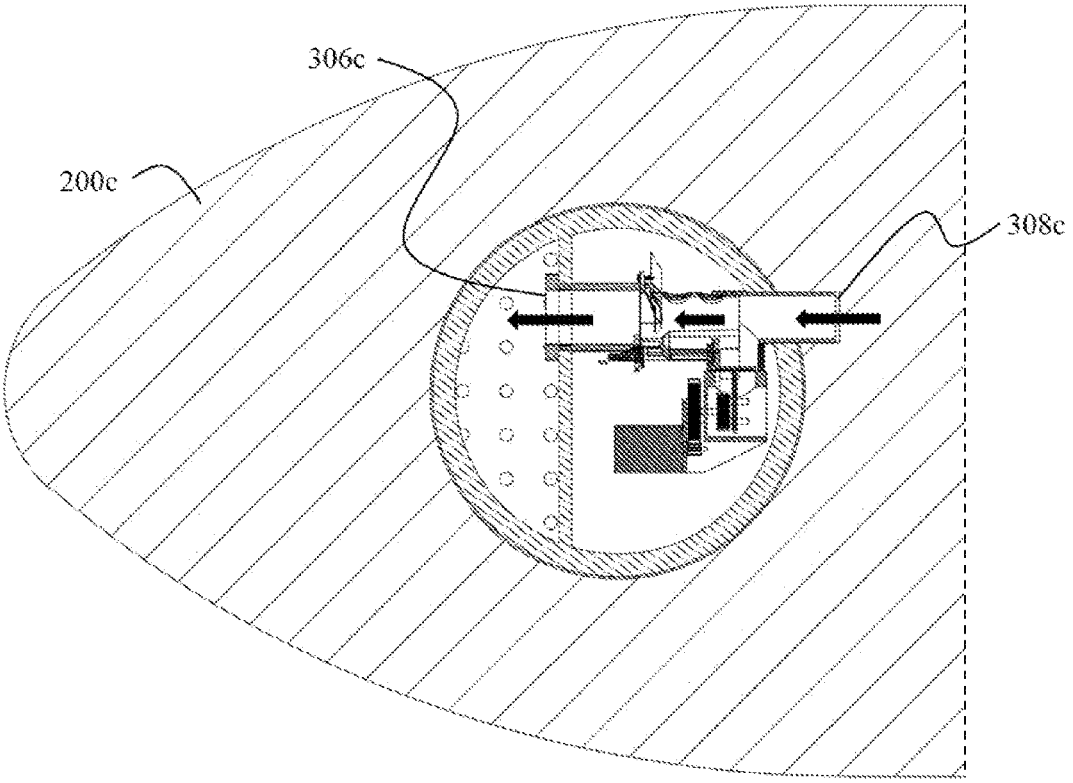
FIG. 10B is a sectional view of the inflatable stand-up paddle board of FIG. 8 in a deflated state.

FIG. 8 is an exploded view of an inflatable stand-up paddle board according to a third example embodiment. FIG. 9 is a further exploded view of the inflatable stand-up paddle board of FIG. 8. FIG. 10A is a sectional view of the inflatable stand-up paddle board of FIG. 8 in an inflated state. FIG. 10B is a sectional view of the inflatable stand-up paddle board of FIG. 8 in a deflated state. An inflatable stand-up paddle board 100*c* includes a stand-up paddle board body 200*c* and an air pump 300*c*. The air pump 300*c* includes an air pump assembly 302*c*, a battery assembly 322*c*, and a casing. The air pump assembly 302*c* includes a driving device (not shown), an air inlet 306*c*, and an air outlet 308*c*. The battery assembly 322*c* includes a switch 324*c*, a recharging port 326*c*, and a power indicator light 328*c*. The air outlet 308*c* communicates with an inflatable chamber via a first vent hole 210*c*. Similar to the second example embodiment, a box bottom 318*c* of a box 314*c* cooperates with a top cover 316*c* to restrain axial displacement of the air pump 300*c*. After the air pump 300*c* is mounted in an installation space, flanges of the box bottom 318*c* and the top cover 316*c* may partially or fully closely fit an inner sheet, a top sheet, or a bottom sheet of the stand-up paddle board body to provide a watertight seal between the flange and the inner sheet or the top sheet. The flanges described above can also provide good airtightness to prevent air leakage of the stand-up paddle board body through the installation space to the outside.

In addition, the air pump assembly further includes a reversing element (not shown). Referring to FIG. 10A, when the reversing element is in a third position, external air passes through the air inlet 306*c* to communicate with the inflatable chamber via the air outlet 308*c* to form a third air channel, and the driving device (not shown) drives air to inflate the inflatable chamber through the third air channel. Referring to FIG. 10B, when the reversing element is in a fourth position after reversion, the inflatable chamber communicates with external air through the air outlet 308*c* via the air inlet 306*c* to form a fourth air channel, and the driving device drives air to deflate the inflatable chamber through the fourth air channel. After a preset air pressure is reached, the driving device of the air pump stops. It should be understood that in the third example embodiment, paths of the third air channel and the fourth air channel are similar but in opposite directions.

Figure 11:
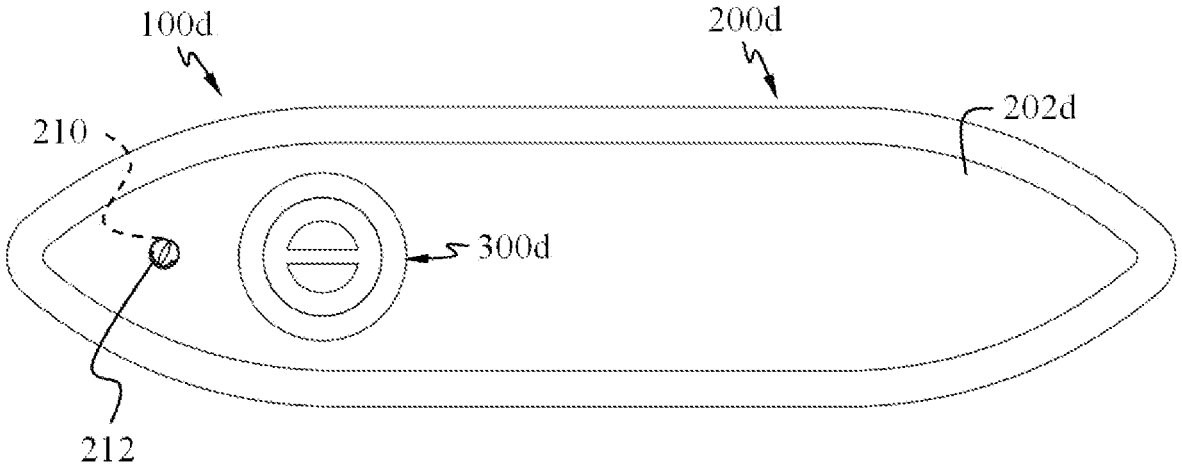
FIG. 11 is a schematic diagram of an inflatable stand-up paddle board according to a fourth example embodiment.
Figure 12:
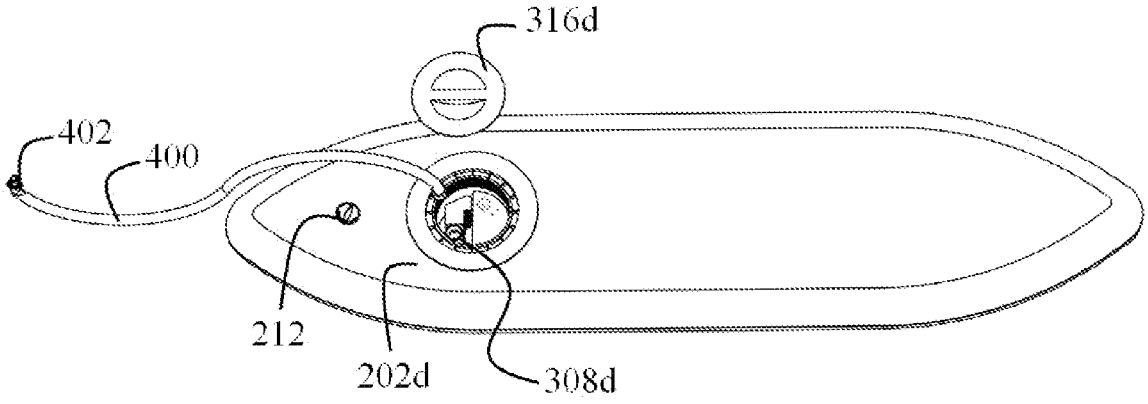
FIG. 12 is an exploded view of the inflatable stand-up paddle board of FIG. 11.
Figure 13:
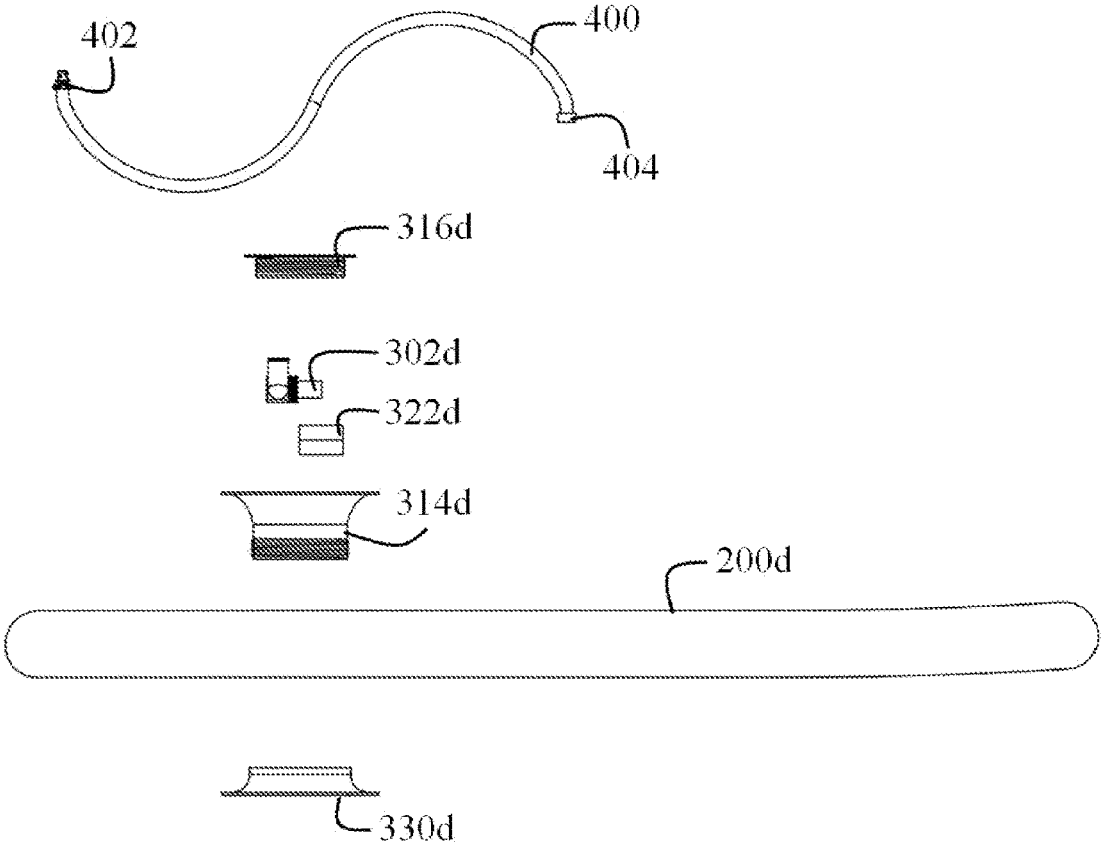
FIG. 13 is a further exploded view of the inflatable stand-up paddle board of FIG. 12.
Figure 14:
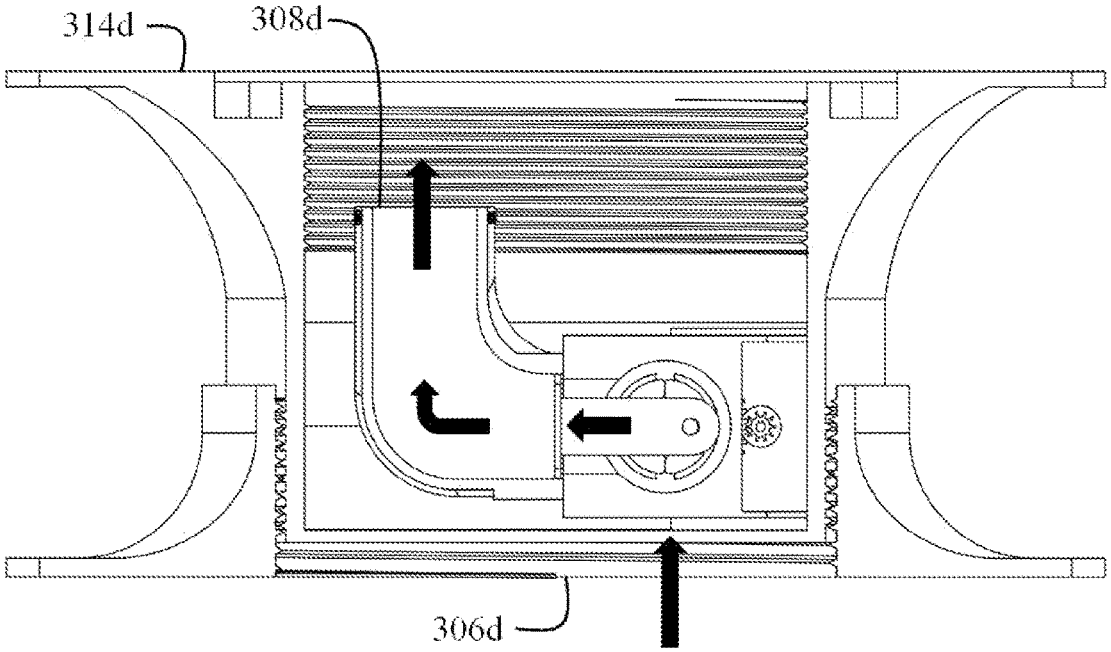
FIG. 14 is a sectional view of the inflatable stand-up paddle board of FIG. 11 in an inflated state.

FIG. 11 is a schematic diagram of an inflatable stand-up paddle board according to a fourth example embodiment. FIG. 12 is an exploded view of the inflatable stand-up paddle board of FIG. 11. FIG. 13 is a further exploded view of the inflatable stand-up paddle board of FIG. 12. FIG. 14 is a sectional view of the inflatable stand-up paddle board of FIG. 11 in an inflated state. An inflatable stand-up paddle board 100*d* includes a stand-up paddle board body 200*d* and an air pump 300*d*. The air pump 300*d* includes an air pump assembly 302*d*, a battery assembly 322*d*, and a casing. The casing is composed of a top cover 316*d*, a box 314*d*, and a bottom cover 330*d*. A flange extending out of the upper end of the box 314*d* and a flange extending out of the bottom of the bottom cover are mounted and then cooperate with each other to restrain axial displacement of the air pump. After the air pump 300*d* is mounted in an installation space, the flanges of the box 314*d* and the bottom cover 330*d* may partially or fully closely fit an inner sheet, a top sheet or a bottom sheet of the stand-up paddle board body to provide a watertight seal between the flange and the inner sheet. The flanges described above can also provide good airtightness to prevent air leakage of the stand-up paddle board body through the installation space to the outside. The air pump assembly 302*d* includes a driving device, an air inlet 306*d* (see FIG. 14), and an air outlet 308*d*. In addition, the top sheet 202*d* of the stand-up paddle board body 200*d* is provided with a vent hole 210, and the vent hole 210 is provided with an air valve 212.

Figure 15:
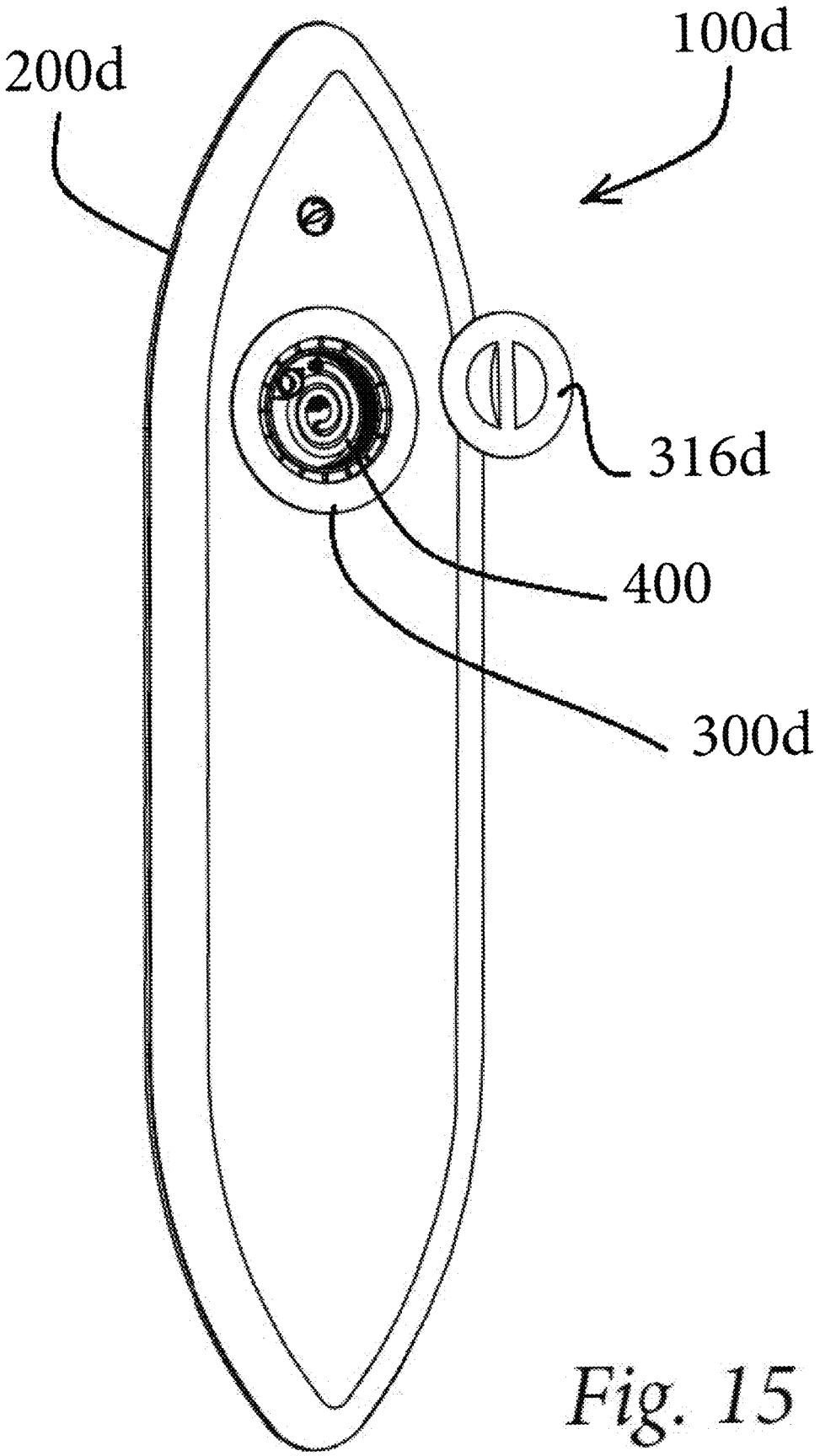
FIG. 15 is another exploded view of the inflatable stand-up paddle board of FIG. 11.

The inflatable stand-up paddle board 100*d* further includes a connecting pipe 400. A first end 402 of the connecting pipe 400 is fitted with an air valve 212, and a second end 404 (see FIG. 13) of the connecting pipe 400 is fitted with an air outlet 308*d*. When the connecting pipe 400 is in a first performable state, that is, when air inflation is being implemented, the first end 402 of the connecting pipe 400 is connected to the vent hole 210 through the air valve 212 so as to communicate with the inflatable chamber, and the second end 404 of the connecting pipe 400 is connected to the air outlet 308*d* of the air pump assembly 302*d*. The driving device (not shown) drives air such that the air is sucked via the air inlet 306*d*, and then the air enters the inflatable chamber through the air outlet 308*d* via the connecting pipe 400, so as to achieve air inflation. In the example embodiment shown in FIG. 14, the air inlet 306*d* is located at the bottom of the box 314*d*. When the connecting pipe 400 is in a second performable state, for example, after air inflation is finished, the first end 402 and the second end 404 of the connecting pipe 400 may be respectively detached from the air valve 212 and the air outlet 308*d*, and the connecting pipe 400 may be coiled and stored in the box 314*d*, as shown in FIG. 15. It should be understood that air deflation in the fourth example embodiment is implemented by the air valve 212.

When the inflatable chamber of the inflatable stand-up paddle board in the fourth example embodiment is being inflated, the first end 402 and the second end 404 of the connecting pipe 400 are first respectively connected to the air valve 212 and the air outlet 308*d* of the air pump assembly 302*d*; then a switch of the battery assembly 322*d* is triggered, the air pump starts to work and inflates the inflatable chamber that was deflated. After a preset air pressure is reached, the driving device of the air pump stops. The first end 402 and the second end 404 of the connecting pipe 400 may be respectively detached from the air valve 212 and the air outlet 308*d* and then the connecting pipe 400 may be coiled and stored in the box 314*d*.

In one or more example embodiments, the vent hole is arranged in the outer sheet of the stand-up paddle board body.

In one or more example embodiments, the connecting pipe may be a corrugated pipe to provide good bending performance.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable board comprising:

a body comprising:

a plurality of outer sheets, and an inner sheet having an upper periphery connected to one of the plurality of outer sheets and a lower periphery connected to another one of the plurality of outer sheets, such that the plurality of outer sheets and the inner sheet define an inflatable chamber therein, and the inner sheet defines an installation space separated from the inflatable chamber by the inner sheet; and an air pump disposed in the installation space, the air pump comprising:

a casing, wherein the casing comprises:

a cylindrical box body comprising an inner side wall and internal threads provided on an upper end of the inner side wall, and a top cover provided with external threads matching the internal threads of the cylindrical box body, thereby providing a detachably sealed connection between the cylindrical box body and the top cover via the internal threads and external threads, and an air pump assembly disposed in the cylindrical box body, the air pump assembly comprising:

an air inlet in communication with an outside of the air pump assembly; and an air outlet in communication with the inflatable chamber via a first vent hole in the inner sheet.

2. The inflatable board according to claim 1, wherein the air pump assembly further comprises:

a switching device configured to switch between a first state, in which air is driven into the inflatable chamber, and a second state in which air is driven out of the inflatable chamber.

3. The inflatable board according to claim 2, wherein:

the body further comprises a second vent hole in the inner sheet; and the air pump assembly further comprises a suction port in communication with the inflatable chamber via the second vent hole.

4. The inflatable board according to claim 1, wherein the casing further comprises a bottom cover detachably connected to the cylindrical box body.

5. The inflatable board according to claim 1, wherein the air pump further comprises a battery assembly disposed in the casing, wherein the battery assembly is electrically connected to the air pump assembly.

6. The inflatable board according to claim 5, wherein the battery assembly comprises a rechargeable battery and a recharging port configured to enable recharging of the battery.

7. The inflatable board according to claim 6, wherein the battery assembly is detachably connected to the air pump.

8. An inflatable board comprising:

a body comprising:

a plurality of outer sheets, an inner sheet having an upper periphery connected to one of the plurality of outer sheets and a lower periphery connected to another of the plurality of outer sheets, such that the plurality of outer sheets and the inner sheet define an inflatable chamber therein, and the inner sheet defines an installation space separated from the inflatable chamber by the inner sheet, and an air valve disposed in a vent hole in one of the plurality of outer sheets;

an air pump disposed in the installation space, the air pump comprising:

a casing, wherein the casing comprises:

a cylindrical box body comprising an inner side wall and internal threads provided on an upper end of the inner side wall, and a top cover provided with external threads matching the internal threads of the cylindrical box body, thereby providing a detachably sealed connection between the cylindrical box body and the top cover via the internal threads and external threads, and an air pump assembly disposed in the cylindrical box body, the air pump assembly comprising:

an air inlet in communication with an outside of the air pump assembly, and an air outlet; and a connecting pipe comprising a first end designed to be coupled to the air valve, and a second end designed to be coupled to the air outlet.

9. The inflatable board according to claim 8, wherein the connecting pipe is moveable between:

a first performable state in which the first end of the connecting pipe is connected to the vent hole through the air valve, and the second end of the connecting pipe is connected to the air outlet; and a second performable state in which the connecting pipe is stored in the casing.

10. An inflatable board comprising:

a body defining an inflatable chamber therein;

a sheet defining an installation space and partitioning the installation space from the inflatable chamber;

a casing disposed in the installation space, wherein the casing comprises:

a cylindrical box body comprising an inner side wall and internal threads provided on an upper end of the inner side wall, and a top cover provided with external threads matching the internal threads of the cylindrical box body, thereby providing a detachably sealed connection between the cylindrical box body and the top cover via the internal threads and external threads;

an air pump assembly disposed in the cylindrical box body, the air pump assembly comprising an air pump, an air inlet in communication with an exterior of the inflatable chamber, and an air outlet in communication with the inflatable chamber via a vent hole in the sheet.

11. The inflatable board according to claim 10, wherein the air pump assembly further comprises a battery electrically connected to the air pump.

12. The inflatable board according to claim 11, wherein the battery is rechargeable and the air pump assembly further comprises a recharging port configured to enable recharging of the battery.

13. The inflatable board according to claim 10, wherein the air pump assembly further comprises a power indicator light.

14. The inflatable board according to claim 10, wherein the air pump assembly further comprises a switch moveable between a first position in which the air pump is configured to drive air into the inflatable chamber and a second portion in which the air pump is configured to draw air out of the inflatable chamber.

15. The inflatable board according to claim 10, further comprising a connecting pipe configured to connect to the air inlet and sized to fit within the cylindrical box body.

16. The inflatable board according to claim 10, further comprising a bottom cover configured to provide a water-tight seal between the installation space and an exterior of the inflatable board.

* * * * *